US007204603B1

(12) United States Patent
Lanczy et al.

(10) Patent No.: US 7,204,603 B1
(45) Date of Patent: Apr. 17, 2007

(54) METHOD OF BEAM AND BASKET CONSTRUCTION FOR LINEAR LIGHTING

(75) Inventors: Geza T. Lanczy, Auburn, IN (US); Rodney A. Williams, Auburn, IN (US); Gregg E. Laukhuf, Bryan, OH (US)

(73) Assignee: Pent Technologies, Inc., Kendallville, IN (US)

( * ) Notice: Subject to any disclaimer, the term of this patent is extended or adjusted under 35 U.S.C. 154(b) by 74 days.

(21) Appl. No.: 11/046,621

(22) Filed: Jan. 28, 2005

Related U.S. Application Data

(60) Provisional application No. 60/540,316, filed on Jan. 29, 2004.

(51) Int. Cl.
*F21S 8/00* (2006.01)

(52) U.S. Cl. ..... 362/150; 362/148; 362/217; 362/220; 362/223; 362/376; 362/396

(58) Field of Classification Search ..... 362/148, 362/150, 217, 220, 223, 376, 396
See application file for complete search history.

(56) References Cited

U.S. PATENT DOCUMENTS

| | | | | |
|---|---|---|---|---|
| 2,323,002 | A * | 6/1943 | Baker | 362/223 |
| 2,525,315 | A * | 10/1950 | Schepmoes | 362/223 |
| 2,946,881 | A | 7/1960 | Pascucci | 240/78 |
| 2,966,325 | A | 12/1960 | Pascucci | 248/343 |
| 3,319,919 | A | 5/1967 | Eisenberg | 248/343 |
| 3,435,204 | A * | 3/1969 | Lepak | 362/223 |
| 4,048,491 | A | 9/1977 | Wessman | 240/78 H |
| 5,025,355 | A | 6/1991 | Harwood | 362/147 |
| 5,526,244 | A | 6/1996 | Bishop | 362/147 |
| 5,624,202 | A | 4/1997 | Grierson | 403/327 |
| 5,964,523 | A | 10/1999 | Eversberg | 362/365 |
| 6,033,085 | A * | 3/2000 | Bowker | 362/223 |
| 6,517,222 | B1 | 2/2003 | Orlov | 362/391 |
| 2002/0021568 | A1 * | 2/2002 | Wardenburg | 362/220 |

* cited by examiner

*Primary Examiner*—Renee Luebke
*Assistant Examiner*—Mary Zettl
(74) *Attorney, Agent, or Firm*—Taylor & Aust, P.C.

(57) ABSTRACT

A lighting system includes a suspended light fixture, a skin, and a plurality of alignment sights. The suspended light fixture includes a supporting spine. The skin partially surrounds the spine. The skin is supported by the spine at at least three points including an adjustable point. The skin is substantially more flexible than the spine. The spine has a plurality of suspension points that define a longitudinal axis. The plurality of alignment sights are connected to the skin along an axis defining a leveling axis. The leveling axis is substantially parallel to and offset from the longitudinal axis.

19 Claims, 3 Drawing Sheets

METHOD OF BEAM AND BASKET CONSTRUCTION FOR LINEAR LIGHTING

CROSS REFERENCE TO RELATED APPLICATIONS

This is a non-provisional application based upon U.S. provisional patent application Ser. No. 60/540,316, entitled "METHOD OF BEAM AND BASKET CONSTRUCTION FOR LINEAR LIGHTING", filed Jan. 29, 2004.

BACKGROUND OF THE INVENTION

1. Field of the Invention

The present invention relates to a method of construction for linear lighting, and, more particularly, to a beam and basket construction method applied to a linear lighting system.

2. Description of the Related Art

Current construction methods for linear lighting do not allow for field adjustability of sag in the fixture. This problem is amplified as the length of the fixture increases and is often times not apparent during initial installation. Additionally, over time the fixture may sag requiring replacement.

In constructing the interior of a building it is not uncommon to install temporary lighting at the positions which permanent lighting will later be installed. Often temporary lighting is installed by utilizing a pigtail incandescent light fixture which is connected to the power wires by utilizing wire nuts, thereby providing temporary lighting for construction workers. When it is time to put the finished light fixtures in, the temporary light fixtures are removed and a new light fixture is installed along with a ceiling to provide the desired cosmetic appearance.

What is needed in the art is a cost effective light fixture assembly for use during construction and final installation.

SUMMARY OF THE INVENTION

The present invention provides a linear lighting system with an attachable adjustable cosmetic skin that can be connected and adjusted around the light fixture.

The invention comprises, in one form thereof, an attachment to a lighting structure having a spine, the attachment including a skin partially surrounding the spine, the skin supported by the spine at at least three points including an adjustable point, the skin being substantially more flexible than the spine.

An advantage of the present invention is that the outer skin of the lighting fixture may be adjusted to a level position.

Another advantage of the present invention is that a less expensive skin may be utilized.

Yet another advantage is that the skin does not have to be self supporting by its own structure apart from the light fixture.

Still another advantage of the present invention is that it includes sighting points along which an installer can insure that the skin is in a aligned position and if it isn't an adjustment screw may be rotated to position the skin in proper alignment.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
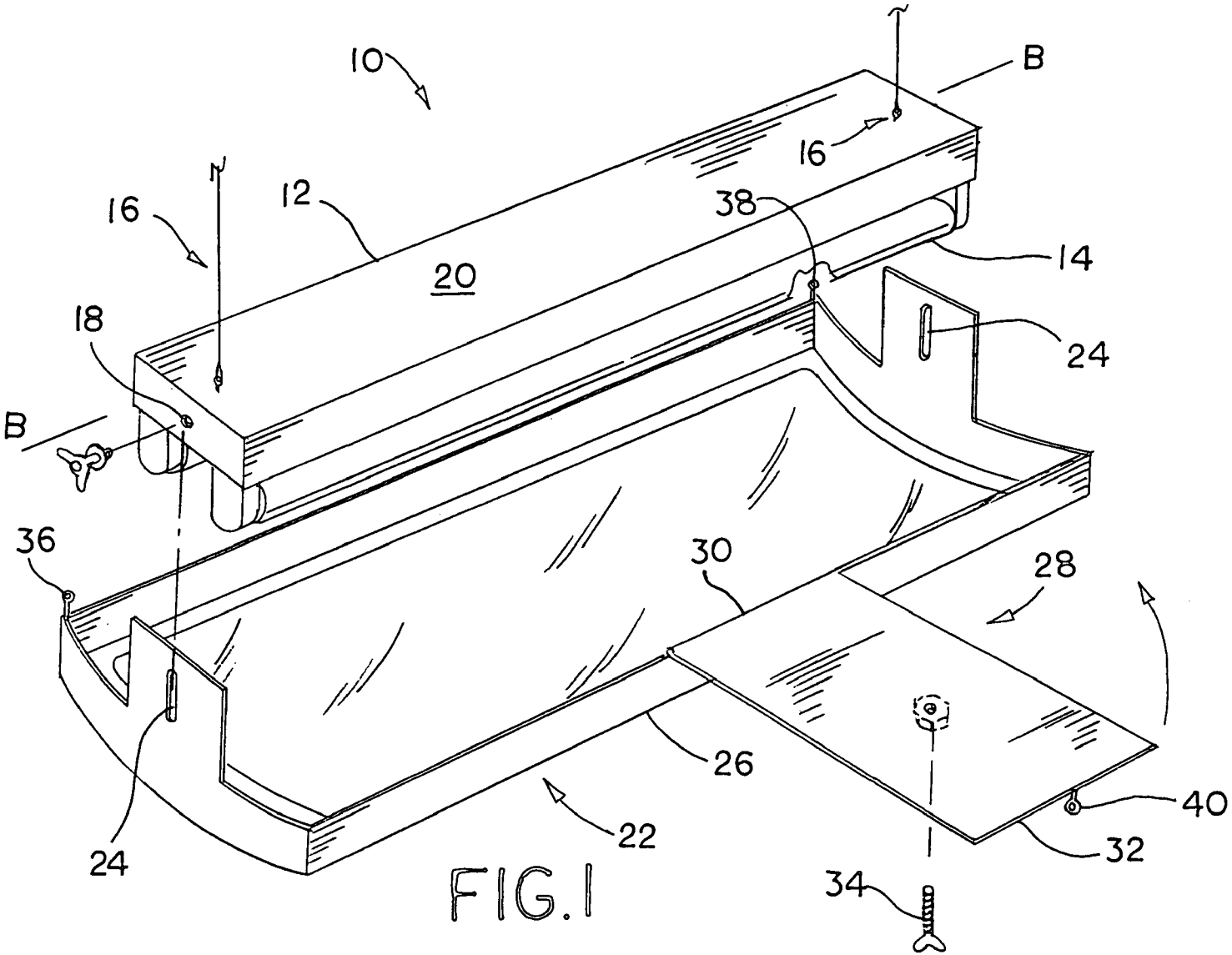
FIG. 1 illustrates a perspective exploded view of an embodiment of the linear lighting system of the present invention.
Figure 2:
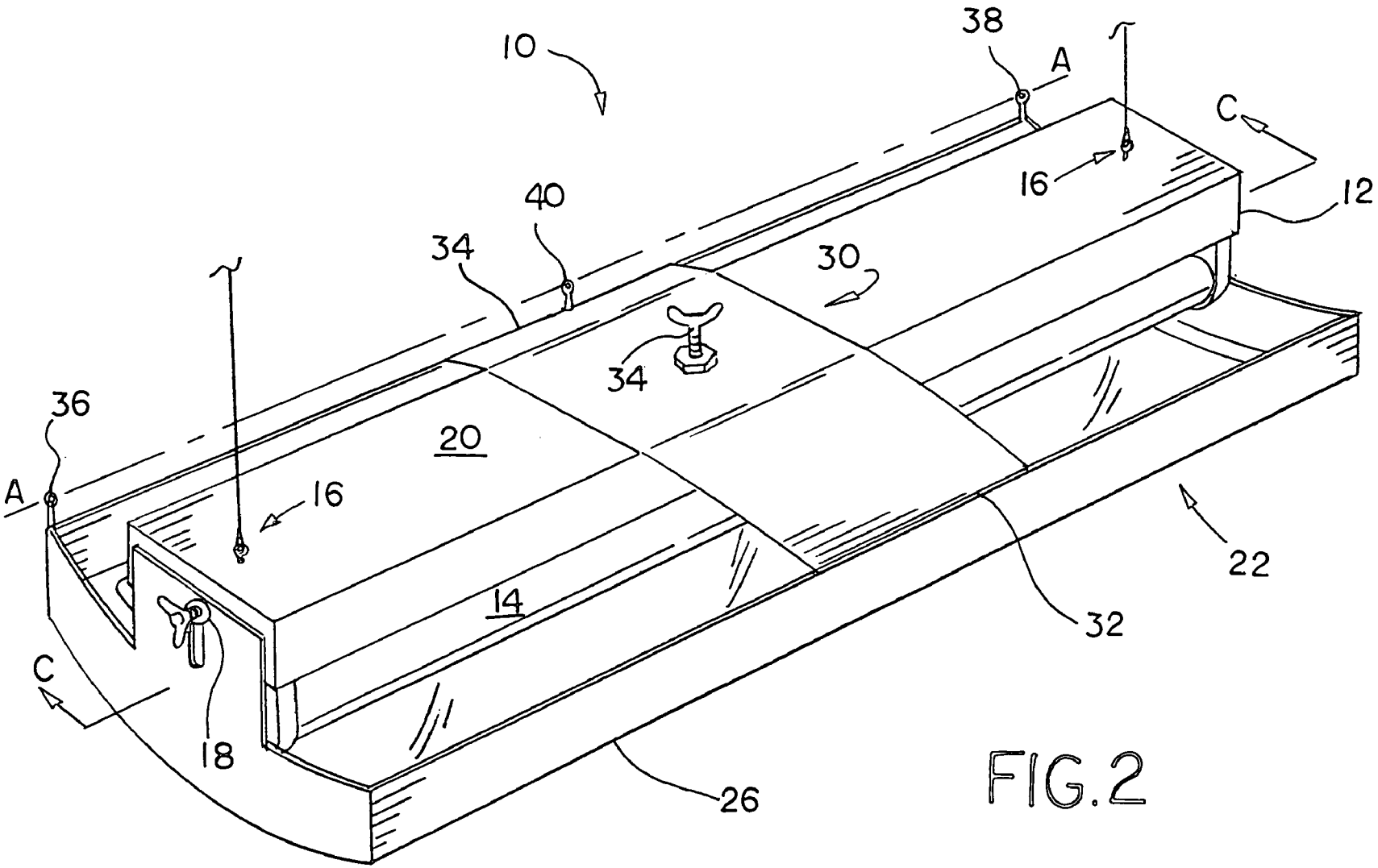
FIG. 2 is a perspective assembled view of the lighting system of FIG. 1.

Referring now to the drawings, and more particularly to FIGS. 1 & 2, there is shown a lighting system 10 including a light fixture 12 also known as a linear lighting fixture 12. Light fixture 12 includes light bulbs 14, suspension arrangement 16, attachment points 18 and spine 20. Light fixture 12 may be a fluorescent lighting fixture commonly used in industrial and office applications. Although a two-bulb fixture is shown, a fixture having more or less than two bulbs can be utilized. Light fixture 12 is be installed during the rough construction phase of a project and skin assembly 22 is applied during a later phase, such as the final installation of the interior features of the workspace.

Light bulbs 14 may be typical fluorescent tubes utilized in fluorescent fixtures. Suspension arrangement 16 allows for a cable or chain connection that is connected to some structural element, not shown. Additionally, electrical power is connected to light fixture 12, which can be advantageously connected directly to a junction box without the need to provide for only a temporary wiring thereto.

Attachment points 18 are located at each end of light fixture 12 for interaction with skin assembly 22 when it is connected to light fixture 12 in the finishing phases of the construction project.

Figure 3:
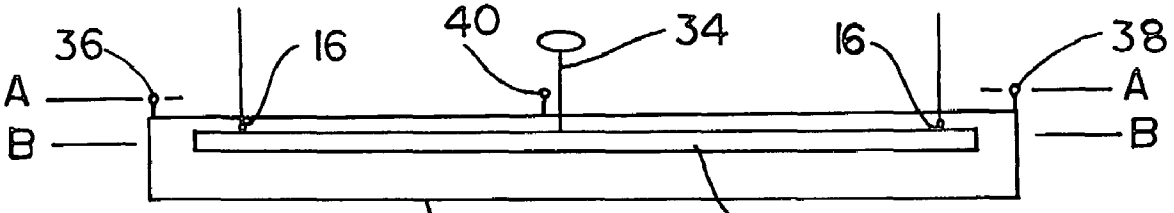
FIG. 3 is a schematic rendition of a side view of the lighting system of FIGS. 1 & 2.
Figure 4:
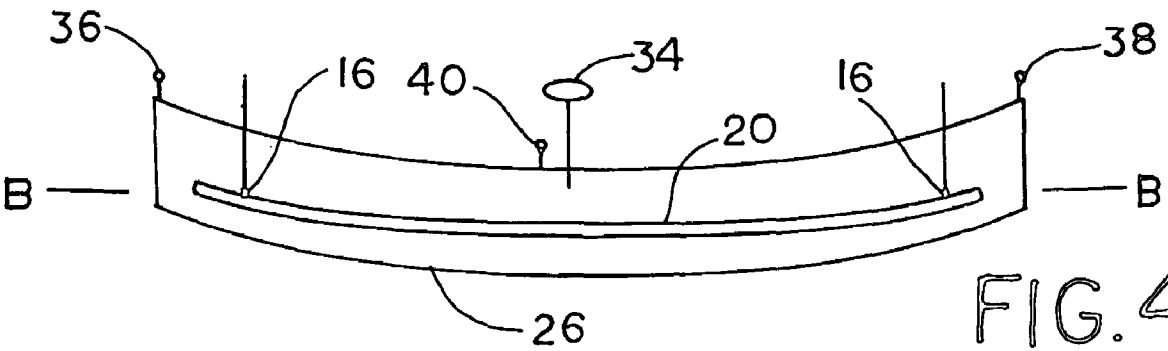
FIG. 4 is another schematic side view of the lighting system of FIGS. 1–3.
Figure 5:
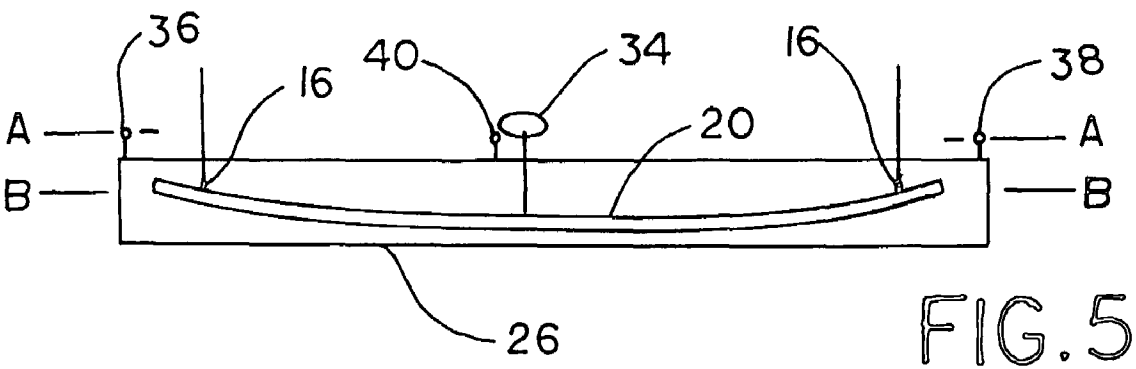
FIG. 5 is yet another side schematic view of the lighting system of FIGS. 1–4.

Now, additionally referring to FIGS. 3–5, spine 20 may be in the form of a beam 20 which exists between suspension arrangements 16. Spine 20 need not be relatively straight between suspension points 16 as illustrated in FIGS. 4 and 5, since spine 20 only provides structural support to skin assembly 22, the actual shape of spine 20 is of little significance.

Light fixture 12 can be thought of as a structural support for the cosmetic skin assembly 22, allowing skin assembly 22 to be positioned at least partially enclosing light fixture 12 and supported by light fixture 12. Since the cosmetic portion, otherwise known as skin assembly 22, is not required to be structurally self-supporting, skin assembly 22 may be made from almost any type of material including paper, wire fabric, plastic, aluminum or plastic extrusions, sheet metal or any multitude of desired materials. While skin assembly 22 can be attached in various ways, depending upon a desired result, a key feature of skin assembly 22 is to allow the installer of skin assembly 22 to make adjustments in the alignment of skin assembly 22 so as to compensate for a natural deflection over the length of skin assembly 22.

Skin assembly 22 includes attachment points 24, a body 26, and a coupling assembly 28 having a first skin coupling 30 and a second skin coupling 32, an adjustment device 34 and alignment sights 36, 38 and 40. Attachment points 24 interact with attachment points 18 of light fixture 12 to connect ends of skin assembly 22 to light fixture 12. Attachment points 24 may themselves be adjustable, for example by way of a slot. Coupling assembly 28 is shown as a singular entity while multiple coupling assemblies may be utilized depending upon the length of skin assembly 22. Coupling assembly 28 includes first skin coupling 30 and second skin coupling 32 each of which are connected to one side of body 26, thereby traversing a portion of spine 20 to provide structural support to skin assembly 22 along the length of skin assembly 22. First skin coupling 30 may be a hinged-type device, have a notched interaction between coupling assembly 28 and body 26 or utilize any other sort of coupling. Second skin coupling 32 is removably connected to another side of body 26 thereby providing support to both sides of body 26.

Alignment sights 36 and 38 are positioned at each end of body 26 and alignment sight 40 is associated with a portion of coupling assembly 28 or is positioned on body 26 proximate to coupling assembly 28. Adjustment device 34 contacts a portion of spine 20 and is adjusted such that an alignment sights 36, 38 and 40 are brought into alignment when sighted by an installer along axis A. When axis A is properly aligned, adjustment device 34 is left in that adjusted position to support body 26 so that it remains aligned relative to axis A. Axis B is associated with the point of contact between suspension arrangement 16 and spine 20 and even though spine 20 may deviate from axis B, axis A is substantially parallel to axis B when body 26 is adjusted into position by the movement of adjustment 34 to thereby align alignment sights 36, 38 and 40, also known as leveling sights 36, 38 and 40. Attachment points 18 and 24 interact with each other and are coplanar with attachment points 18 and 20, suspension points 16 and axis B.

During installation of skin assembly 22 to light fixture 12, attachment points 24 are connected to attachment points 18 which serves to establish relative positions of leveling sights 36 and 38. Coupling assembly 28 is then hinged or coupled into place to each side of body 26. As can be seen in FIG. 3, if spine 20 is coaxial with axis B and adjustment device 34, which may be in the form of a jackscrew 34, requires very little adjustment to position leveling sights 36, 38 and 40 in alignment with axis A. However, if light fixture 12 sags, as shown in FIG. 4 or even if skin assembly 22 is simply out of alignment, leveling sights 36, 38 and 42 are not aligned as shown in FIG. 4. Rotation of jack screw 34 applies a compressive force against spine 20 and the elevation of body 26 so that leveling sight 40 is brought into alignment with axis A, as shown in FIG. 5.

Advantageously the present invention allows for adjustments to compensate for natural deflections over the length of skin assembly 22, deflections of spine 20 and for skin assembly 22 to have limited structural strength. These attributes lead allow light system 10 to be economically utilized in a initial and final construction phases. For example, this allows a light fixture 12 to be initially installed to provide light to construction workers and light fixture 12 remains as the finished light fixture without the need of replacing a temporary light fixture. Additionally, the present invention advantageously allows the realignment of skin assembly 22 if either spine 20 and/or skin assembly 22 sag over time.

Leveling sights 36, 38 and 40 are used in a manner similar to sighting down a shotgun barrel by utilizing sighting beads at the two ends and proximate to coupling assembly 28. This allows the installer to level the fixture without any tools such as a level or the need to pull a string taught from one end of a fixture to the other end of the fixture. Additionally, the installer may sight from one fixture to another fixture along leveling beads 36, 38 and 40 to assure a relative leveling between individual lighting systems 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An attachment to a lighting structure having a spine, the attachment comprising:

a skin partially surrounding the spine, said skin supported by the spine at at least three points including an adjustable point, said skin being substantially more flexible than the spine, the spine having a plurality of suspension points that define a longitudinal axis; and a plurality of alignment sights connected to said skin along an axis defining a leveling axis, said leveling axis being substantially parallel to and offset from said longitudinal axis.

2. The attachment of claim 1, wherein said adjustable point has a range of adjustment that allow the alignment of said plurality of alignment sights along said leveling axis.

3. The attachment of claim 2, wherein said at least three points defining an attachment plane that is substantially parallel to said longitudinal axis.

4. The attachment of claim 3, wherein said leveling axis is substantially parallel to said attachment plane.

5. The attachment of claim 1, wherein said plurality of alignment sights are three alignment beads positioned along said skin.

6. The attachment of claim 1, wherein said adjustable point is a device that is threadedly engaged with at least one of said skin and the spine.

7. The attachment of claim 1, wherein said skin includes at least one longitudinal side having an edge, at least two of said plurality of alignment sights being located along said edge.

8. A lighting system, comprising:

a suspended light fixture including a supporting spine;

a skin partially surrounding said spine, said skin supported by said spine at at least three points including an adjustable point, said skin being substantially more flexible than said spine, said spine having a plurality of suspension points that define a longitudinal axis; and a plurality of alignment sights connected to said skin along an axis defining a leveling axis, said leveling axis being substantially parallel to and offset from said longitudinal axis.

9. The system of claim 8, wherein said adjustable point has a range of adjustment that allow the alignment of said plurality of alignment sights along said leveling axis.

10. The system of claim 9, wherein said at least three points defining an attachment plane that is substantially parallel to said longitudinal axis.

11. The system of claim 10, wherein said leveling axis is substantially parallel to said attachment plane.

12. The system of claim 8, wherein said adjustable point is a device that is threadedly engaged with at least one of said skin and said spine.

13. The system of claim 8, wherein said skin includes at least one longitudinal side having an edge, at least two of said plurality of alignment sights being located along said edge.

14. A method of installing a lighting system, comprising the steps of:

suspending a light fixture;

partially enclosing said light fixture with a skin;

attaching two points of said skin to said light fixture; and aligning said skin at a third point along said light fixture and aligning leveling sights along a length of said skin.

15. The method of claim 14, wherein said aligning step includes adjusting a leveling protrusion that extends from a portion of said skin to said third point of said light fixture.

16. A method of installing a lighting system, comprising the steps of:

suspending a light fixture;

partially enclosing said light fixture with a skin;

attaching two points of said skin to said light fixture; and aligning said skin at a third point along said light fixture and leveling sights along a length of said skin, said leveling sights including at least three beads spaced apart along an alignment axis.

17. A method of installing a lighting system, comprising the steps of:

suspending a light fixture;

partially enclosing said light fixture with a skin;

attaching two points of said skin to said light fixture; and aligning said skin at a third point along said light fixture and adjusting said skin at said third point to align at least three beads.

18. A method of installing a lighting system, comprising the steps of:

suspending a light fixture;

partially enclosing said light fixture with a skin;

attaching two points of said skin to said light fixture; and aligning said skin at a third point along said light fixture and adjusting said skin at said third point to align at least three beads, each of said at least there beads being associated with a corresponding one of said points of said skin.

19. A method of installing a lighting system, comprising the steps of:

suspending a light fixture;

partially enclosing said light fixture with a skin;

attaching two points of said skin to said light fixture;

aligning said skin at a third point along said light fixture and adjusting a leveling protrusion that extends from a portion of said skin to said third point of said light fixture; and sighting along a plurality of leveling sights to provide information for the adjusting of said protrusion.

* * * * *